US007086487B2

(12) United States Patent
Nguyen

(10) Patent No.: US 7,086,487 B2
(45) Date of Patent: Aug. 8, 2006

(54) ANTI-MUD PACKING SEAL GLAND

(75) Inventor: Don Quy Nguyen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 242 days.

(21) Appl. No.: 10/602,844

(22) Filed: Jun. 24, 2003

(65) Prior Publication Data

US 2004/0000435 A1 Jan. 1, 2004

Related U.S. Application Data

(60) Provisional application No. 60/392,814, filed on Jul. 1, 2002.

(51) Int. Cl.
*E21B 10/25* (2006.01)

(52) U.S. Cl. ..... 175/371

(58) Field of Classification Search ..... 175/371; 277/399, 400

See application file for complete search history.

(56) References Cited

U.S. PATENT DOCUMENTS 4,277,110 A * 7/1981 Fox ..... 384/94
4,279,316 A * 7/1981 Helmick ..... 175/371
4,610,319 A 9/1986 Kalsi
4,738,323 A * 4/1988 Mathews ..... 175/371

FOREIGN PATENT DOCUMENTS

GB 2026576 A 2/1980
GB 2283037 A 4/1995
GB 2332461 A 6/1999
GB 2347701 A 9/2000

* cited by examiner

*Primary Examiner*—Kenneth Thompson
(74) *Attorney, Agent, or Firm*—Bracewell & Giuliani LLP

(57) ABSTRACT

An earth boring bit has a seal cavity that is eccentric to agitate drilling fluid and avoid mud packing. The bit body having bit legs, each having a bearing pin. A cone rotatably mounts on the bearing pin. Teeth are formed or mounted on the cone for cutting the earth formation as the bit rotates. The cone has a backface adjacent the bit leg and an entrance portion to the cavity that intersects the backface. A seal assembly is in stationary engagement with the bearing pin and sliding engagement with the cone. An annular seal gland is located between an outer diameter portion of the bearing pin and the entrance portion of the cavity. The seal gland has a width that varies so that as the cone rotates, the width of the seal gland at any point along the outer diameter portion of the bearing pin changes at least once per revolution of the cone.

21 Claims, 5 Drawing Sheets

ANTI-MUD PACKING SEAL GLAND

CROSS-REFERENCE TO RELATED APPLICATION

This application claims priority to provisional application Ser. No. 60/392,814, filed Jul. 1, 2002.

FIELD OF THE INVENTION

This invention relates in general to earth-boring roller cone drill bits, and in particular to features for reducing mud packing around the seal gland.

BACKGROUND OF THE INVENTION

Rolling cone earth boring bits have been used for many years for drilling wells. The bit has a body with at least one leg, usually three. A bearing pin depends from each bit leg, extending inward and downward toward the axis of rotation of the bit body. A cone with teeth on its exterior mounts rotatably to each bearing pin.

The cone has a cavity that fits over the bearing pin. The cavity has an entrance portion or mouth adjacent the junction of the bit leg and the bearing pin. A seal is located at the entrance to seal the cavity form cuttings and drilling mud. Most well drilling rolling cone bits are filled with a lubricant that is sealed by the seal at the cavity mouth.

Many different seals have been used in the past as well as today. One type has a rigid seal ring that extends around the bearing pin and is urged by an elastomeric energizer ring into sliding engagement with a seal face in the cone cavity. The seal face rotates with the cone, while the seal ring and energizer ring are stationary with the bearing pin. An elastomeric excluder ring may be located between the bit leg and the outer ends of the energizer ring for keeping drilling mud and cuttings from the seal. While successful, sometimes mud packing occurs at the seal, causing damages to the seal.

SUMMARY OF THE INVENTION

In this invention, the annular seal cavity that contains the seal is made non-uniform. The volume of the seal cavity differs when measured around the outer diameter of the bearing pin, with at least one point having a greater volume or lesser volume than other points in the seal cavity. Consequently, as the cone rotates, the volume changes cyclically, creating a pumping action to circulate drilling fluid from the seal cavity.

In one embodiment, the difference in volume is accomplished by changing the radial width of the seal cavity from one point to another. This is preferably done by making the mouth eccentric relative to the bearing pin axis. The mouth is preferably circular, but has its axis offset from the bearing pin axis.

In one embodiment, the eccentric groove of the mouth is spaced radially from the seal assembly. In another embodiment, the eccentric groove of the mouth is located outward from the seal and is closely spaced to a seal boss formed on the bearing pin.

In a third embodiment, the backface of the cone contains a plurality of vanes. The vanes rotate in close proximity to a last machined surface formed on the bearing pin to provide a positive pressure.

DETAILED DESCRIPTION OF THE INVENTION

Figure 1:
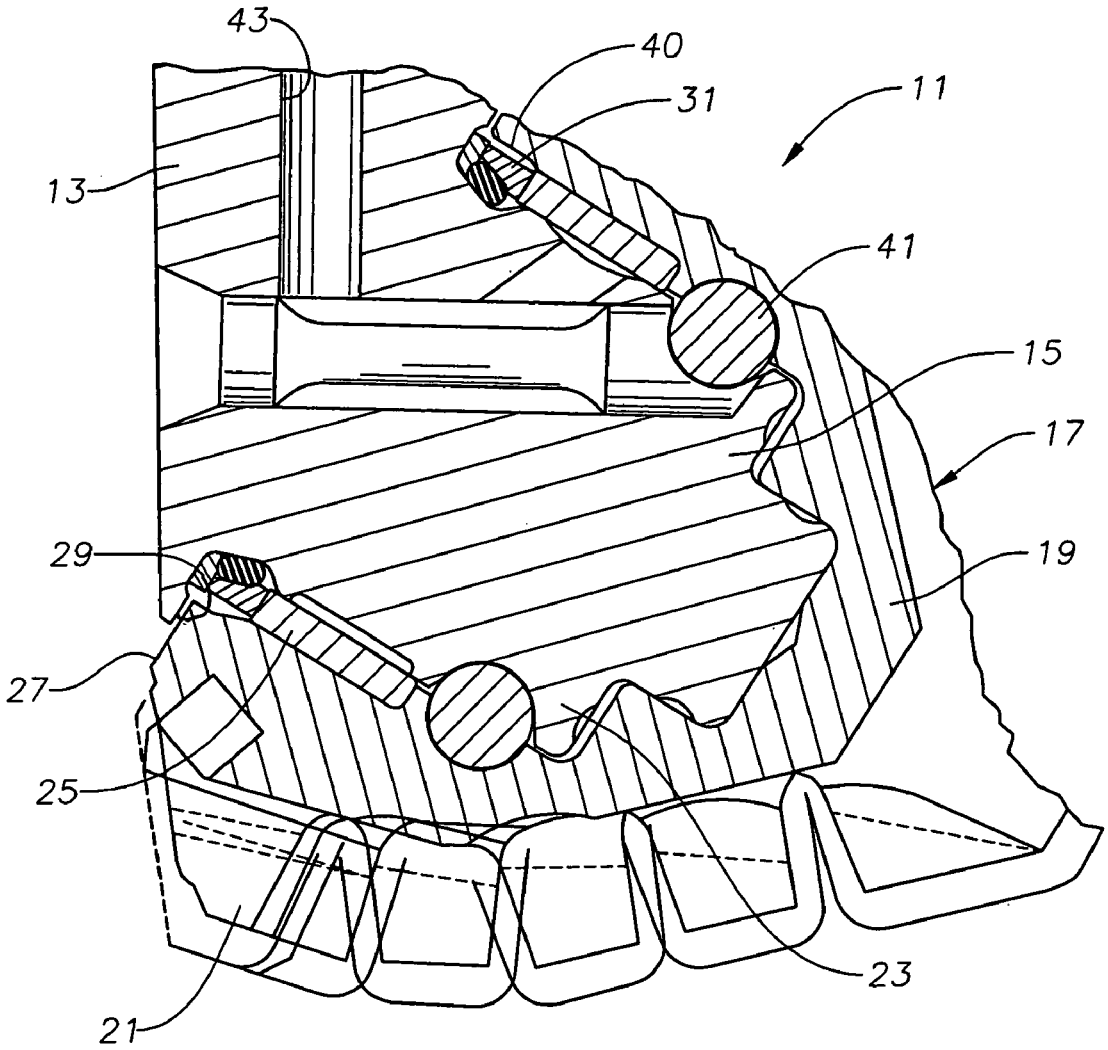
FIG. 1 is a partial sectional view of one roller cone and bearing pin of a bit constructed in accordance with this invention.

Referring to FIG. 1, bit 11 has three legs 13, only one of which is shown. Each bit leg 13 has a depending bearing pin 15, which is a cylindrical member that points downward and inward relative to an axis of rotation of bit 11. A cone 17 is rotatably carried on bearing pin 15. Cone 17 has a cone body 19 and a plurality of teeth 21. Teeth 21 are shown to be steel teeth that are milled from body 19, but they could also be hard metal inserts, such as tungsten carbide, inserted into holes within cone body 19. Cone body 19 has a bearing cavity 23 that fits over bearing pin 15. In this embodiment, a seal insert ring 25 is press-fitted within cavity 23 and rotates with cone 17.

Cone 17 has a backface 27 that is located on the outer end of cone 17 and faces bit leg 13. Backface 27 is placed very close to but not touching a last machined surface 29 formed at the base of bearing pin 15 where it joins bit leg 13. Last machined surface 29 also includes a depending portion on the lower side of bit leg 13, called a shirttail. A seal assembly 31 is located at the base of bearing pin 15 for sealing lubricant within cone cavity 23.

Figure 2:
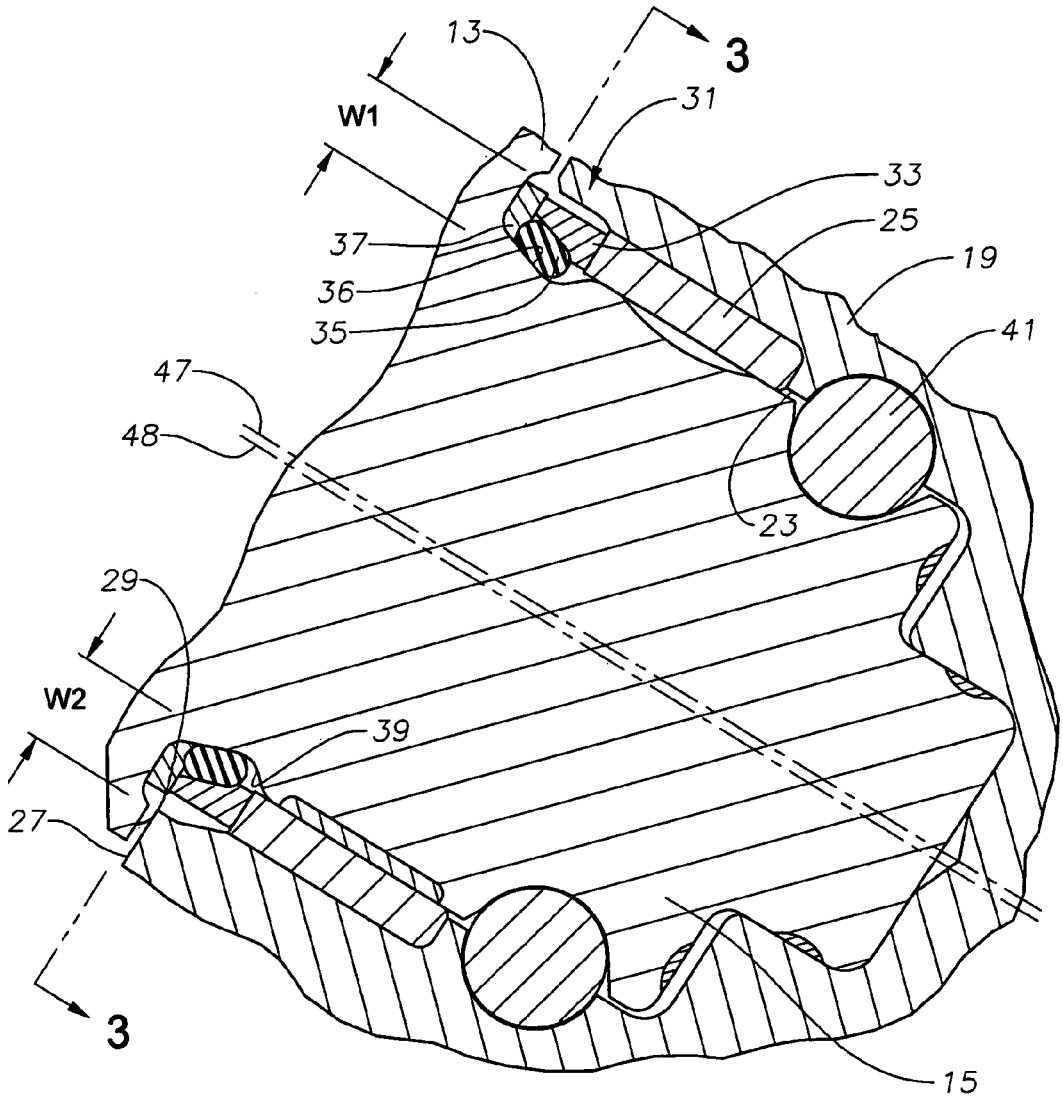
FIG. 2 is an enlarged view of a portion of the bit of FIG. 1.

Referring to FIG. 2, seal assembly 31 in this embodiment includes a metal ring 33 that is stationary with bearing pin 15 and engages seal insert 25 in rotating sliding contact. An elastomeric energizing ring 35 is stationarily located in an annular recess 36 on bearing pin 15 and provides a bias force to urge metal ring 33 against the seal face of insert 25. An elastomeric excluder ring 37 is deformed between last machined surface 29 and the outer ends of metal ring 33 and energizing ring 35 for preventing entry of drilling mud and debris. Numerous other seal assemblies are suitable in lieu of seal assembly 31.

Cone 17 is retained on bearing pin 15 by a plurality of locking balls 41, shown in FIG. 1, although other types of retention are possible, such as snap rings. Lubricant passages 43 supply lubricant from a reservoir (not shown) to locking balls 41 and to the bearing spaces in sliding contact between cone 17 and bearing pin 15.

Cone cavity 23 has an entrance portion or mouth 40 that is an annular surface located radially outward from seal assembly 31 relative to an axis 47 of bearing pin 15. An annular seal cavity 39, which contains seal assembly 31, is defined by annular recess 36 on the outer diameter of bearing pin 15 and cone mouth 40. Seal cavity 39 has a radial width, measured between recess 36 and mouth 40. Seal cavity 39 also has an axial depth, measured from last machined surface 29 to the outer end of seal insert ring 25. The volume of seal cavity 39, measured at any point around recess 36 is the radial width times the axial depth. This volume is not constant around recess 36, rather varies continuously.

Figure 3:
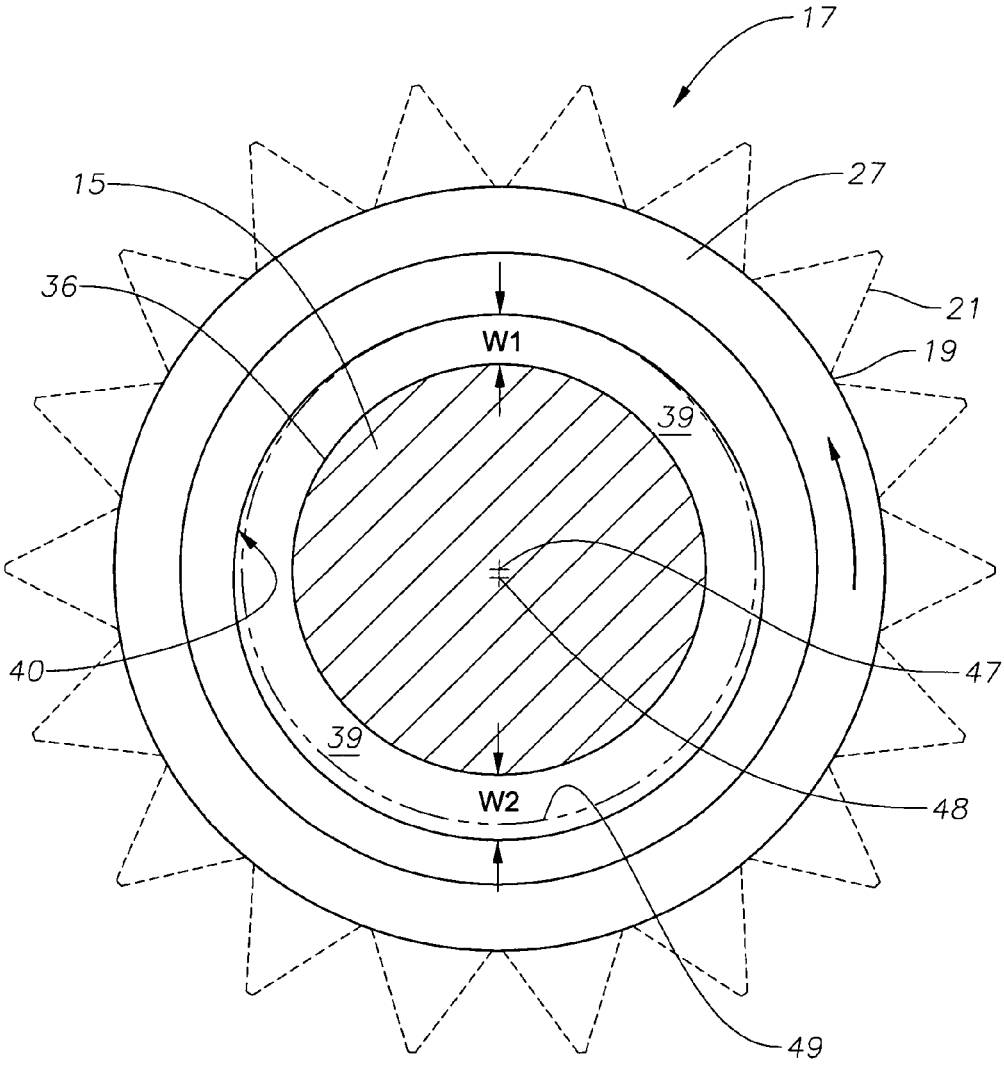
FIG. 3 is a sectional view of the bit of FIG. 1, taken along the line 3—3 of FIG. 2, with the seal assembly omitted.
Figure 4:
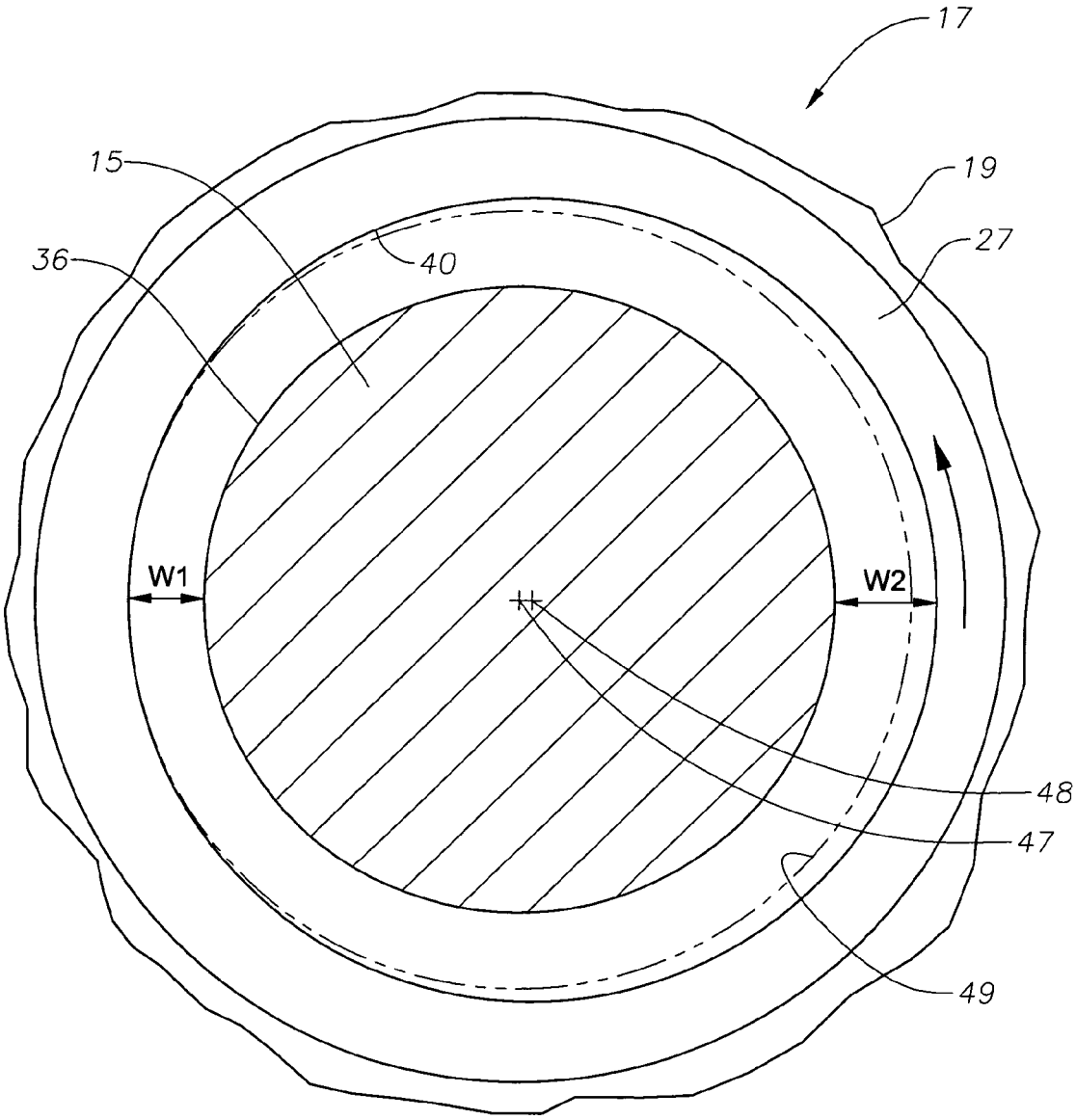
FIG. 4 is a sectional view similar to FIG. 3, but showing the cone further rotated from the position of FIG. 3.

In the preferred embodiment, the varying volume is due to a varying radial width of seal cavity 39. As shown in FIGS. 2–4, mouth 40 is eccentric relative to bearing pin axis 47. In the preferred embodiment, mouth 40 is circular, but has an axis 48 that is offset from bearing pin axis 47. The eccentricity results in varying radial width for seal cavity 39. The width varies from a minimum radial width W1, located on the upper side in FIGS. 2 and 3 to a maximum radial width W2, located on the lower side in FIGS. 2 and 3. The minimum radial width point W1 is 180 degrees from the maximum radial width point W2. The change in width is gradual from minimum width point W1 to maximum width point W2.

Mouth 40 is spaced radially outward of the outer diameter of metal seal ring 33, defining an annular clearance between the outer diameter of metal seal ring 33 and mouth 40. The annular clearance forms a part of seal cavity 39. Because of the eccentricity, this annular clearance also varies in width also.

The dotted lines 49 of FIGS. 3 and 4 indicate mouth 40 if it were conventional, which is circular and concentric to bearing pin axis 47. Mouth 40 is preferably made eccentric by increasing the diameter slightly and shifting its axis 48 relative to the axis of rotation 47. As cone 17 rotates, minimum width portion W1 and maximum width portion W2 rotate past any selected point on seal assembly 31 once per revolution.

In operation, when bit 11 is rotated, cone 17 will rotate concentrically about bearing pin axis 47 as indicated by the arrows of FIGS. 3 and 4. FIG. 4 shows cone body 19 rotated approximately 90° from the position of FIG. 3. The minimum and maximum width points W1 and W2 of cone mouth 40 thus have rotated 90° from the position shown in FIG. 3. As cone 17 rotates, seal cavity 39 changes in width, and thus volume, at each point on the circumference of metal seal ring 33. The wider width point W2 will rotate with cone 17 about bearing pin 15 as well as the lesser width point W1.

Figure 5:
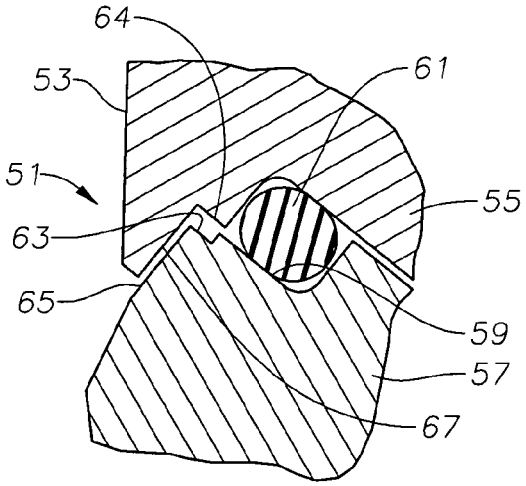
FIG. 5 is a partial sectional view of an alternate embodiment of a bit constructed in accordance with this invention.

FIG. 5 shows a bit 51 that is similar to bit 11, however, it does not use a metal face seal 33 (FIG. 2). Bit 51 has a bit leg 53 and bearing pin 55. Cone 57 has an annular recess or seal gland 59 at the entrance to its cavity that receives an elastomeric seal 61, preferably an O-ring. Seal 61 is deformed between seal gland 59 and the outer diameter of bearing pin 55 close to bit leg 53. Seal gland 59 extends to a mouth of the cavity of cone 57 at backface 65.

An eccentric grooved portion 63 is formed at the mouth of the cone cavity, which is at the corner between seal gland 59 and backface 65. Eccentric portion 63 is preferably a circular groove that has an axis offset from the axis of rotation of cone 57. A seal boss 64 is machined on bit leg 57 radially inward from eccentric portion 63. The radial gap between the cylindrical wall of eccentric portion 63 and seal boss 64 varies around the circumference of seal boss 64. This change in radial width results in minimum and maximum radial width portions rotating around seal boss 64 as cone 57 rotates. The change in radial width between eccentric portion 63 and seal boss 64 results in a cyclic change in volume in seal gland 64. This creates a pumping action tending to pump drilling mud from seal gland 59 outward to reduce mud packing. Eccentric portion 63 thus functions in the same manner as the eccentric mouth 40 of the first embodiment to reduce mud packing.

Figure 6:
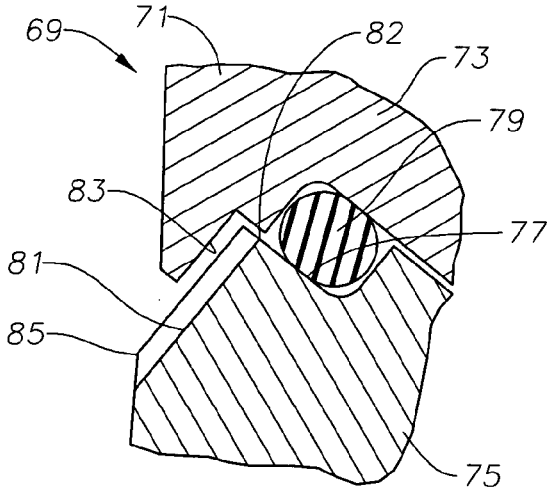
FIG. 6 is a partial sectional view of another alternate embodiment of a bit constructed in accordance with this invention.

FIG. 6 shows another embodiment. Bit 69 has a bit leg 71, from which depends a bearing pin 73. A cone 75 rotates concentrically on bearing pin 73. Cone 75 has a seal gland 77 that contains a seal 79. Seal 79 is shown as an elastomeric O-ring, but it could be other types. Cone 75 has a backface 81 surrounding mouth 82 of the cavity of cone 75. As in the other embodiments, backface 81 is closely spaced to but not touching last machined surface 83. Last machined surface 83 is contained in a plane perpendicular to the axis of bearing pin 73. The lower portion of last machined surface 83 is referred to as a shirttail.

Figure 7:
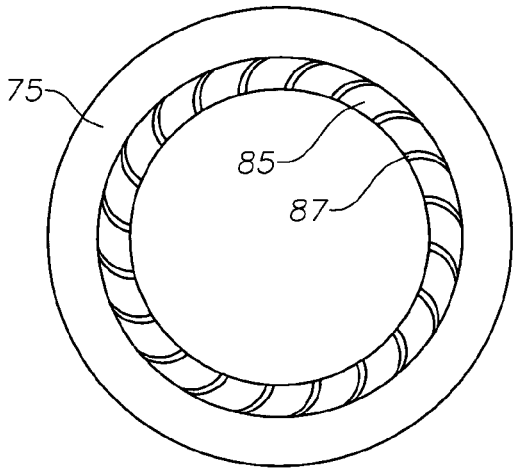
FIG. 7 is an end view of the cone of the bit of FIG. 6, the cone shown removed and with the teeth omitted.

In this embodiment, a plurality of curved vanes 85 are formed on backface 81 as shown in FIG. 7. Vanes 85 extend from cavity mouth 82 to the outer diameter of backface 81 and are spaced from last machined surface 83 by a gap. Each vane 85 curves in a manner to create a differential pressure between the seal cavity surrounding gland 77 and the exterior, with the pressure being greater in the seal cavity 77. This pressure tends to cause drilling fluid to circulate out of seal gland 77. Vanes 85 cause the volume of the seal cavity, which includes seal gland 77 and the gap between backface 85 and last machined surface 83, to change at any selected point on last machined surface 83 due to rotation of cone 75.

Other configurations to provide a variable volume for the seal cavity are feasible. For example, the cone mouth could be noncircular but rotate about the bearing pin axis. The cone mouth could be oblong or have one or more recess portions within it that result in a noncircular inner diameter at the entrance portion of the cone cavity. These recess portions could be formed at different radial distances from the seal assembly. The change in seal cavity volume need not occur gradually as in the first embodiment. There could be more than one maximum width and minimum width portions, as provided by the vanes of the third embodiment. Rather than gaps between the cone and bearing pin differing in radial dimension, recess portions could extend axially from the backface of the cutter at different distances to change the volume of the seal cavity at different points around the circumference of the cavity mouth. In that instance, the mouth could have a circular diameter that is concentric with the bearing pin axis.

The invention has significant advantages. This rotational change in volume of seal cavity 39 causes agitation of the drilling mud that locates around seal assembly 31 (FIG. 1). The agitation discourages mud packing in this area. The dynamic pressure within the seal gland changes as the cone rotates, causing a positive pressure in the seal gland over the exterior to circulate drilling fluid from the seal gland. This agitation is accomplished without any addition components.

While the invention has been shown in only three of its forms, it should be apparent to those skilled in the art that it is not so limited but is susceptible to various modifications without departing from the scope of the invention.

I claim:

1. An earth boring bit adapted to be loaded with weight from a drill string during operation, comprising:

a body having at least one bit leg with a bearing pin depending therefrom;

a cone that is rotatably mounted on the bearing pin;

a seal in engagement with the bearing pin and the cone, the seal having an interior side exposed to lubricant within the cone and an exterior side adapted to be exposed to drilling fluid for sealing the lubricant from the drilling fluid; and the cone having an annular surface on an exterior side of the seal separated from an annular surface of the bearing pin by a clearance into which drilling fluid is adapted to flow, the annular surface of the bearing pin being concentric with an axis of the bearing pin, the annular surface of the cone having at least one portion spaced closer to the annular surface of the bearing pin than at least one other portion when the bit is unloaded and when loaded, so that rotation of the cone when the bit is in operation causes a reduction at each point around the clearance as said at least one portion rotates around the bearing pin.

2. An earth boring bit, comprising:

a body having at least one bit leg with a bearing pin depending therefrom;

a cone that is rotatably mounted on the bearing pin;

a seal cavity between the bearing pin and the cone;

a seal within the seal cavity in engagement with the bearing pin and the cone; and the seal cavity having a volume that differs when measured at one circumferential point than other circumferential points when the bit is unloaded and when loaded; and wherein the volume of the seal cavity measured at any selected point around the circumference of the bearing pin changes at least once per revolution of the cone when the bit is in operation.

3. The bit according to claim 2, wherein a radial width of the seal cavity measured at any selected point around the circumference of the bearing pin changes at least once per revolution of the cone.

4. The bit according to claim 2, wherein the seal cavity has a mouth that is circular and has an axis that is offset from the axis of the bearing pin.

5. The bit according to claim 2, wherein a radial width of the seal cavity increases gradually from a minimum width point to a maximum width point 180 degrees from the minimum width point.

6. The bit according to claim 2, wherein an annular clearance is located between the seal cavity and an outer diameter of the seal, the annular clearance varying in radial width around the outer diameter of the seal.

7. The bit according to claim 2, wherein the seal comprises:

a metal seal ring;

an elastomeric energizer ring that in stationary contact with the bearing pin and urging the metal seal ring into contact with a seal face that rotates with the cone; and wherein an annular space is located between an outer diameter of the metal seal ring and the seal cavity, the annular space having a radial width that varies around the outer diameter of the metal seal ring.

8. The bit according to claim 2, wherein the seal comprises:

a metal seal ring;

an elastomeric energizer ring that in stationary contact with the bearing pin and urging the metal seal ring into contact with a seal face that rotates with the cone; and wherein the seal cavity has a greater inner diameter than an outer diameter of the metal seal ring and an axis offset from an axis of the metal seal ring.

9. The bit according to claim 2, wherein the seal comprises an elastomeric ring, and wherein the seal cavity has a groove that is located outward of the ring, the groove being spaced radially from a seal boss formed on the bit leg, the groove being eccentric relative to an axis of the bearing pin.

10. The bit according to claim 1, wherein:

the annular surface of the cone is eccentric relative to the axis of the bearing pin.

11. The bit according to claim 1, wherein:

the annular surface of the bearing pin is a cylindrical surface of a seal boss that is coaxial with the axis of the bearing pin; and the annular surface of the cone is spaced radially from the cylindrical surface of the seal boss and is eccentric relative to the axis of the bearing pin.

12. The bit according to claim 1, wherein:

the annular surface of the bearing pin comprises a machined surface extending around the bearing pin at a junction of the bearing pin with the bit leg;

the annular surface of the cone comprises a backface of the cone; and said at least one portion comprises at least one vane protruding from the backface.

13. An earth boring bit that is adapted to be loaded with weight from a drill string during operation, comprising:

a body having at least one bit leg with a bearing pin depending therefrom;

a cone having a cavity for rotatably mounting the cone on the bearing pin;

an entrance portion of the cavity extending around an outer diameter portion of the bearing pin, defining an annular seal cavity that has a radial width that varies so that as the cone rotates when the bit is unloaded and when loaded, the width of the seal cavity at any point along the outer diameter portion of the bearing pin changes at least once per revolution of the cone; and a seal in the seal cavity for sealing between the cone and the bearing pin.

14. The bit according to claim 13, wherein the radial width of the annular clearance increases gradually from a minimum point to a maximum point 180 degrees from the minimum point.

15. The bit according to claim 13, wherein the entrance portion of the cavity is circular and has an axis that is offset from an axis of rotation of the cone.

16. The bit according to claim 13, wherein the width of the seal cavity changes once per revolution at any point along the outer diameter portion of the bearing pin.

17. The bit according to claim 13, wherein the seal comprises:

a metal seal ring; and an elastomeric energizer ring that is in stationary contact with the bearing pin and urges the metal seal ring into contact with a seal face that rotates with the cone.

18. The bit according to claim 13, wherein:

the seal comprises an elastomeric ring;

the outer diameter portion of the bearing pin comprises a seal boss located outward from the ring; and an eccentric groove is formed at the entrance portion of the cavity.

19. An earth boring bit that is adapted to be loaded from weight of a drill string during operation, comprising:

a body having at least one bit leg with a bearing pin depending downward and inward therefrom;

a cone having a cavity that concentrically receives the bearing pin for rotation about an axis of the bearing pin, the cavity having a seal face located therein and a mouth at an entrance portion of the cavity;

a seal assembly in stationary engagement with the bearing pin and sliding engagement with the seal face in the cavity of the cone; and the mouth of the cavity being circular about an axis that is offset from the axis of the bearing pin while the bit is unloaded and when loaded, so that the mouth of the cavity rotates eccentrically relative to the bearing pin during operation of the bit.

20. The bit according to claim 19, wherein the mouth of the cavity is spaced radially from the seal assembly.

21. The bit according to claim 19, wherein the seal assembly comprises:

a metal seal ring; and an elastomeric energizer ring that is in stationary contact with the bearing pin and urges the metal seal ring into contact the seal face; and wherein the mouth is radially spaced from an outer diameter of the metal seal ring by an annular clearance.

* * * * *

UNITED STATES PATENT AND TRADEMARK OFFICE

CERTIFICATE OF CORRECTION

PATENT NO. : 7,086,487 B2
APPLICATION NO. : 10/602844
DATED : August 8, 2006
INVENTOR(S) : Don Quy Nguyen It is certified that error appears in the above-identified patent and that said Letters Patent is hereby corrected as shown below:

Column 1, line 28, delete “form” and insert --from-- before “cuttings”
Column 1, line 40, delete “damages” and insert -- damage--
Column 3, line 22, delete “also” before “varies”

Signed and Sealed this

Fifth Day of December, 2006

JON W. DUDAS
*Director of the United States Patent and Trademark Office*